US011458747B2

(12) United States Patent
Watanabe

(10) Patent No.: US 11,458,747 B2
(45) Date of Patent: Oct. 4, 2022

(54) PRINTING APPARATUS

(71) Applicant: SEIKO EPSON CORPORATION, Tokyo (JP)

(72) Inventor: Ikumi Watanabe, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/467,521

(22) Filed: Sep. 7, 2021

(65) Prior Publication Data

US 2022/0072877 A1 Mar. 10, 2022

(30) Foreign Application Priority Data

Sep. 9, 2020 (JP) ..... JP2020-151075

(51) Int. Cl.
*B41J 11/66* (2006.01)

(52) U.S. Cl.
CPC ..... *B41J 11/663* (2013.01)

(58) Field of Classification Search
CPC ..... B41J 11/663; B41J 11/70; B41J 11/009; B41J 2203/01; B41J 29/38
See application file for complete search history.

(56) References Cited

U.S. PATENT DOCUMENTS

2009/0224020 A1* 9/2009 Ol ..... B65H 26/00 226/10
2013/0077120 A1* 3/2013 Miyazawa ..... B41J 3/44 358/1.13
2017/0344861 A1* 11/2017 Shirasaka ..... B41J 11/703

FOREIGN PATENT DOCUMENTS

JP 2012-126012 A 7/2012

* cited by examiner

*Primary Examiner* — Scott A Richmond
(74) *Attorney, Agent, or Firm* — Global IP Counselors, LLP

(57) ABSTRACT

A processor prints medium information on a medium using a printing head in response to reception of a replacement instruction for the medium, causes a printing apparatus to cut the medium in a state in which a downstream end of the medium information is located further on the upstream than a downstream roller, and, thereafter, enables the medium to be detached.

6 Claims, 10 Drawing Sheets

PRINTING APPARATUS

The present application is based on, and claims priority from JP Application Serial Number 2020-151075, filed Sep. 9, 2020, the disclosure of which is hereby incorporated by reference herein in its entirety.

BACKGROUND

1. Technical Field

The present disclosure relates to a printing apparatus.

2. Related Art

There is a printing apparatus that performs printing on a long medium such as a medium for printing wound in a roll shape such as roll paper. In such a printing apparatus, the medium is sometimes replaced before being used up. For example, there is also a printing apparatus that prints, on a medium to be replaced, information indicating an attribute of the medium such as a residual amount and, when the medium is attached again, grasps the attribute of the attached medium from the information.

JP-A-2012-126012 (Patent Literature 1) discloses an image forming apparatus that records a paper information code corresponding to paper information of roll paper in the roll paper as a paper information image unrecognizable by a human visual sense.

There is a demand for saving a medium. However, related art such as Patent Literature 1 does not consider saving of a medium.

SUMMARY

A printing apparatus according to an aspect of the present disclosure includes: an upstream roller configured to convey a medium; a downstream roller configured to convey the medium; a sensor; a printing head configured to perform, in a printing position, printing on the medium conveyed by the upstream roller on the upstream and by the downstream roller on the downstream; and a processor configured to perform control on a new medium based on medium information read from the new medium using the sensor. The processor prints the medium information on the medium using the printing head in response to reception of a replacement instruction for the medium, causes the printing apparatus to cut the medium in a state in which a downstream end of the medium information is located further on the upstream than the downstream roller, and, thereafter, enables the medium to be detached.

DESCRIPTION OF EXEMPLARY EMBODIMENTS

Embodiments of the present disclosure are explained according to order described below.

Figure 1:
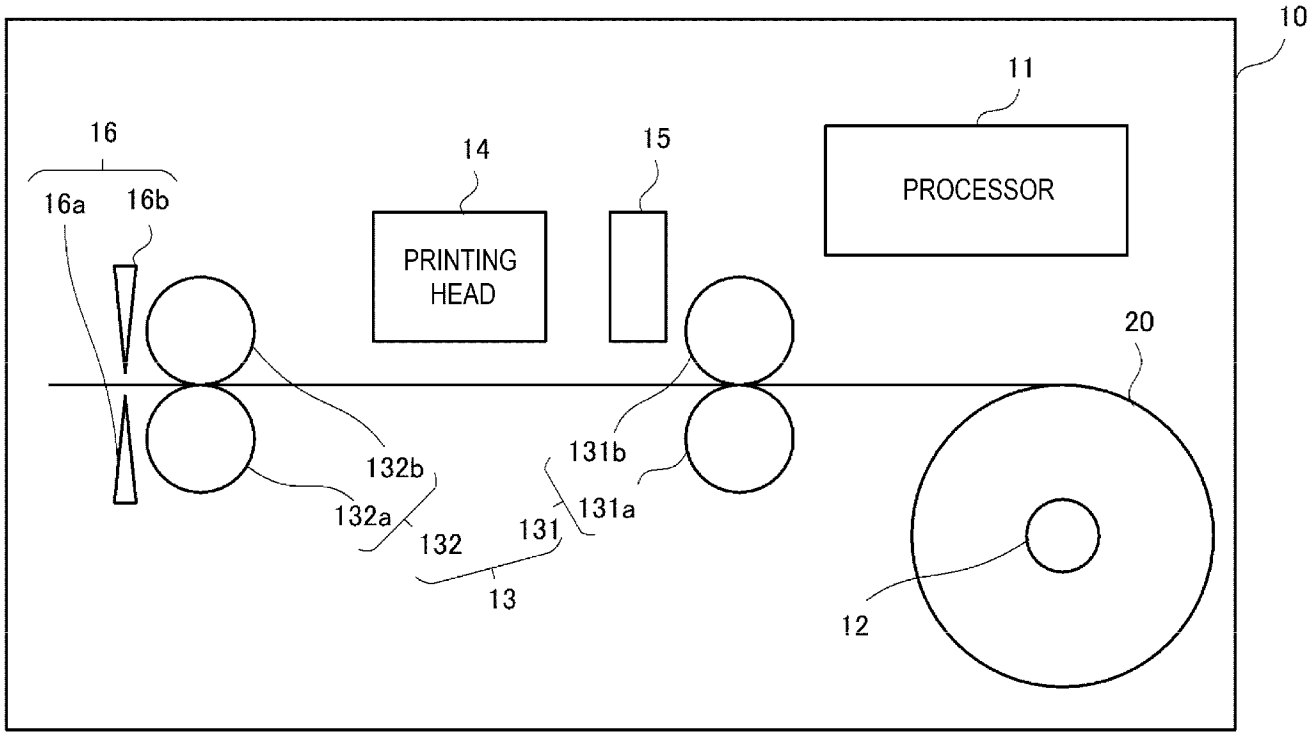
FIG. 1 is a diagram showing an example of the configuration of a printing apparatus.

(1) Configuration of a printing apparatus
(2) Processing of the printing apparatus
(2-1) Overview
(2-2) Details of processing for detaching a medium
(2-3) Details of processing for attaching a medium
(3) Other embodiments (1) Configuration of a Printing Apparatus FIG. 1 is a diagram showing an example of the configuration of a printing apparatus 10 in an embodiment. The printing apparatus 10 in this embodiment is an inkjet-type printing apparatus that includes a mechanism for attaching a medium 20 for printing wound in a roll shape and performs conveyance and printing of the attached medium 20. The medium 20 is roll paper obtained by winding high-quality paper, cast paper, art paper, coat paper, synthetic paper, or the like in this embodiment but may be a medium obtained by winding a printing film, cloth, or the like in a roll shape. In this embodiment, the outer surface of the medium 20 is a printing surface (a surface used for printing). The outer surface is a surface on the medium 20 forming the outermost surface of the medium 20 wound in the roll shape. The inner surface of the medium 20 is a surface on the opposite side of the outer surface on the medium 20. That is, the printing apparatus 10 performs printing on the outer surface side of the medium 20.

The printing apparatus 10 includes a processor 11, a medium rotating shaft 12, a conveying roller 13, a printing head 14, a sensor 15, and a cutter 16. The printing apparatus 10 includes a storage (for example, a read only memory (ROM), a hard disk drive (HDD), or a solid state drive (SSD)) that stores various programs, various kinds of setting information, information concerning the medium 20, and the like.

The processor 11 includes a random access memory (RAM), a central processing unit (CPU), and the like and controls the printing apparatus 10. The processor 11 can execute a program recorded in a storage of the printing apparatus 10.

The medium rotating shaft 12 is a shaft to which the medium 20 is attached. The medium rotating shaft 12 is used for rotation of the medium 20. The processor 11 rotates the medium 20 using the medium rotating shaft 12 to feed the medium 20 in a conveying direction and wind the medium 20.

The conveying roller 13 is a roller used for conveyance of the medium 20 and includes at least an upstream roller 131 and a downstream roller 132.

The upstream roller 131 is a pair of upper and lower rollers (upstream rollers 131*a* and 131*b*) used for conveyance of the medium 20. At least one of the upstream rollers 131*a* and 131*b* is rotatable by a motor controlled by the processor 11. The downstream roller 132 is a pair of upper and lower rollers (downstream rollers 132*a* and 132*b*) used for conveyance of the medium 20 and is disposed downstream of the upstream roller 131 on a conveyance path of the medium 20. In the following explanation, the conveyance path of the medium 20 is simply referred to as conveyance path. When two points in different positions in the conveying direction of the medium 20 at the time when printing is performed are compared, the point that the medium 20 passes first is represented as upstream and the point that the medium 20 passes later is represented as downstream. At least one of the downstream rollers 132*a* and 132*b* is rotatable by a motor controlled by the processor 11.

The upstream roller 131 and the downstream roller 132 respectively nip the medium 20 with the pairs of upper and lower rollers thereof and rotate in that state to convey the medium 20.

The printing head 14 ejects four kinds of inks of CMYK (C: cyan, M: magenta, Y: yellow, and K: black) to perform printing. The printing head 14 is disposed in the middle between the upstream roller 131 and the downstream roller 132 in the conveyance path of the medium 20. The printing head 14 ejects the inks to the medium 20 to perform printing in a state in which the medium 20 is conveyed by both of the upstream roller 131 and the downstream roller 132.

In the state in which the medium 20 is conveyed by both of the upstream roller 131 and the downstream roller 132, the medium 20 is nipped by both of the upstream roller 131 and the downstream roller 132. That is, both the ends in the conveying direction of the medium 20 are pressed in the up-down direction between the upstream roller 131 and the downstream roller 132. Accordingly, the posture of the medium 20 is stabilized between the upstream roller 131 and the downstream roller 132. The printing head 14 can more stably perform the printing by performing printing in such a state.

The colors and the number of colors of the inks ejected by the printing head 14 are examples. Inks of other colors and other numbers of colors may be used. The processor 11 can control ink ejection amounts, ejection timings, and the like of the inks from ejection nozzles of the printing head 14.

The sensor 15 is an optical sensor used for reading of information printed on the medium 20. In this embodiment, the sensor 15 is disposed further on the downstream than the upstream roller 131 and further on the upstream than the printing head 14 in the conveyance path. However, the sensor 15 may be disposed in another position such as a position further on the upstream than the upstream roller 131. The processor 11 can read the information printed on the medium 20 using the sensor 15.

The cutter 16 is an edged tool used to cut the medium 20. In this embodiment, the cutter 16 includes a pair of upper and lower edge tools (edge tools 16*a* and 16*b*) but is not limited to this. The cutter 16 is disposed on the downstream of the downstream roller 132 in the conveyance path of the medium 20. At least one of the edge tools 16*a* and 16*b* can be driven to move up and down by a motor controlled by the processor 11. The cutter 16 drives at least one of the edge tools 16*a* and 16*b* according to an instruction from the processor 11 to nip and cut the medium 20 with the edge tools 16*a* and 16*b*.

(2) Processing of the Printing Apparatus

Subsequently, processing of the printing apparatus 10 is explained.

(2-1) Overview

First, an overview of the processing of the printing apparatus 10 is explained.

First, processing for detaching and attaching a medium in a processing apparatus of related art is explained with reference to FIGS. 2 to 5. A hardware configuration of the printing apparatus of the related art is the same as the hardware configuration of the printing apparatus 10. In the following explanation, components respectively corresponding to the components 11 to 16, 131, 131*a*, 131*b*, 132, 132*a*, 132*b*, 16*a*, and 16*b* in the printing apparatus 10 are described as components 31 to 36, 331, 331*a*, 331*b*, 332, 332*a*, 332*b*, 36*a*, and 36*b* in the printing apparatus of the related art. A medium 40, which is the same medium as the medium 20, is attached to the printing apparatus of the related art.

Figure 2:
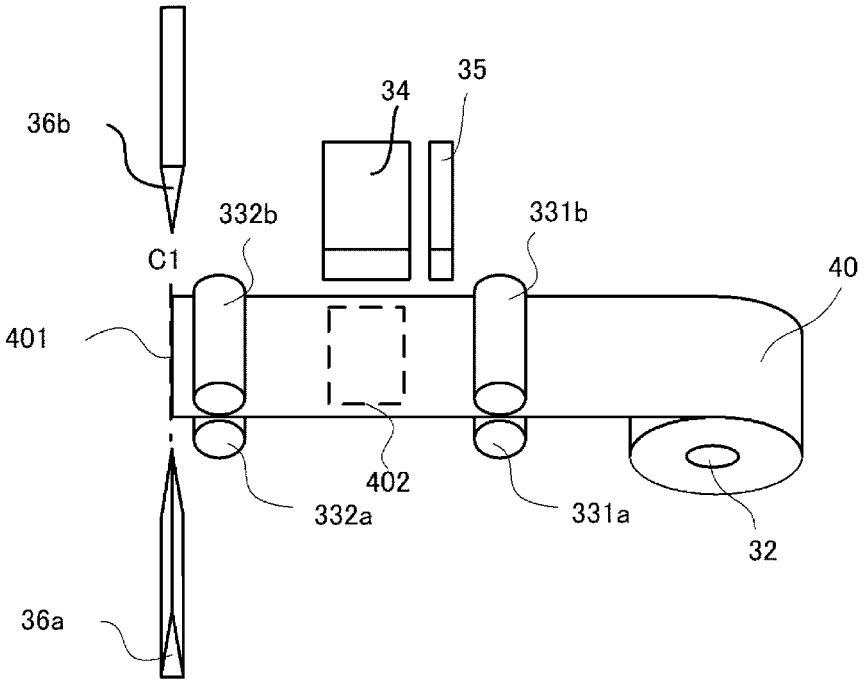
FIG. 2 is a diagram for explaining an overview of a medium cut of related art.

In a state in which printing is completed, the printing apparatus of the related art receives a replacement instruction for the medium 40 for printing through operation of an input section (for example, a button or a touch panel) of the printing apparatus by a user. When receiving the replacement instruction for the medium 40, the printing apparatus of the related art conveys the medium 40 such that a downstream end 401 of the medium 40 reaches a predetermined position (a cut position of a cutter 36) on the conveyance path. In FIG. 2, a state in which the medium 40 is conveyed until the downstream end 401 reaches the cut position of the cutter 36 is shown.

The printing apparatus of the related art prints, in a printing position 402 of a printing head 34 on the medium 40, medium information 41 indicating information concerning the medium 40 (for example, attributes, a date of use, a date of purchase, and user setting information of the medium 40). The attributes of the medium 40 include, for example, a type, a residual amount, a printing surface (an outer surface or an inner surface) of the medium 40. The printing position is a position in a range in which the printing head is capable of performing printing. In this embodiment, a barcode is used as the medium information.

Figure 3:
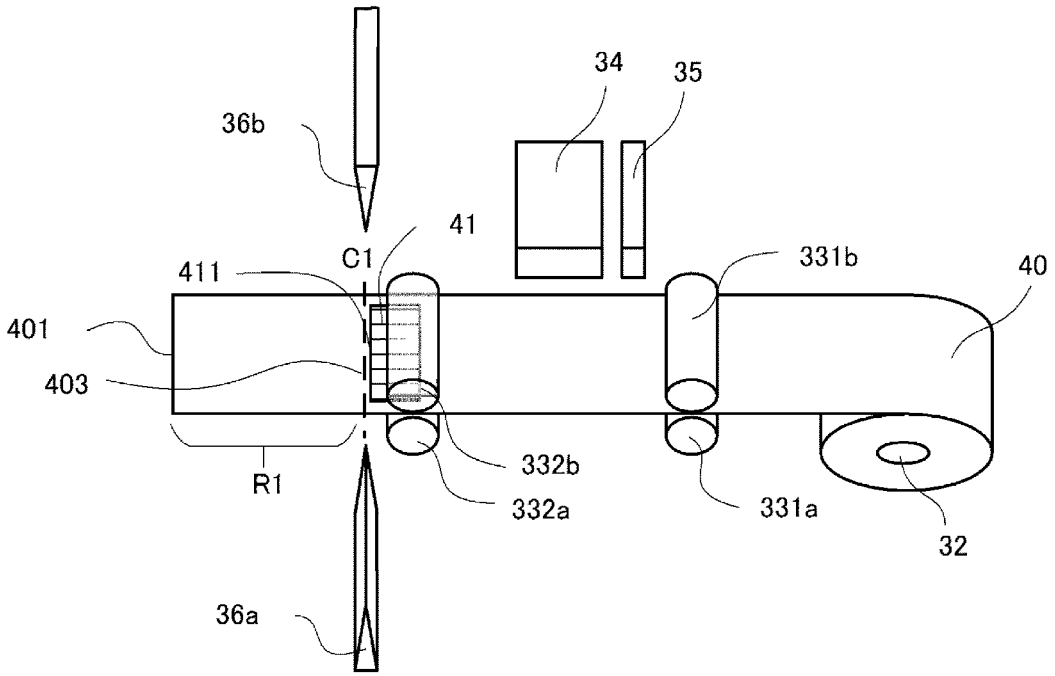
FIG. 3 is a diagram for explaining the overview of the medium cut of the related art.

Thereafter, as shown in FIG. 3, the printing apparatus of the related art conveys the medium 40 until an downstream end 411 of the medium information 41 reaches the vicinity on the upstream of a cut position C1 of the cutter 36. Since the cutter 36 is disposed downstream of a downstream roller 332, the position of the downstream end 411 is downstream of the downstream roller 332. The printing apparatus of the related art cuts the medium 40 using the cutter 36. That is, a region R1 at the downstream end 411 of the medium 40 is cut in a state in which the downstream end 411 is located downstream of the downstream roller 332. After cutting the medium 40, the printing apparatus of the related art rewinds the medium 40 into a roll shape to enable the medium 40 to be detached. Thereafter, the medium 40 is detached by the user. In this way, in the printing apparatus of the related art, when the medium 40 is detached, the region R1 from the downstream end 401 to the vicinity of the downstream end 411 is cut. A downstream end 403 of the medium 40 at the time when the region R1 is cut is in the same position as the upstream end of the region R1 before the cut.

Figure 4:
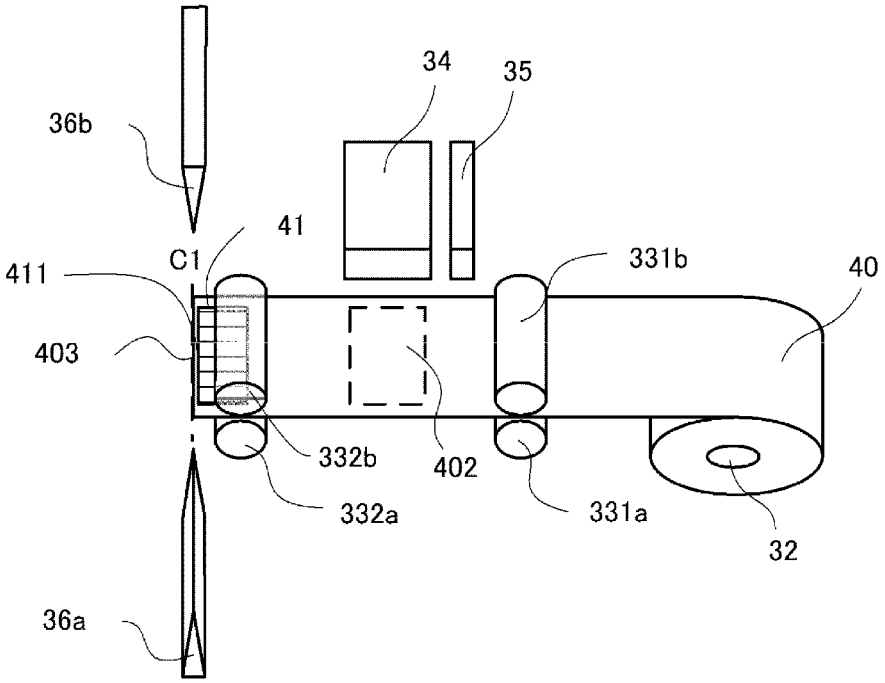
FIG. 4 is a diagram for explaining the overview of the medium cut of the related art.

When the medium 40 is attached again, the printing apparatus of the related art conveys the medium 40 until the medium information 41 present in the vicinity of a downstream end 403 enters a reading range of a sensor 35. The printing apparatus of the related art reads the medium information 41 via the sensor 35 and grasps information concerning the attached medium 40. Thereafter, when printing is instructed, the printing apparatus of the related art conveys the medium 40 until the downstream end 403 reaches the cut position C1 of the cutter 36. In FIG. 4, a state in which the medium 40 is conveyed until the downstream end 403 reaches the cut position C1 of the cutter 36 is shown. After nipping the medium 40 with the downstream roller 332, the printing apparatus of the related art performs, using the printing head 34, printing in the printing position 402 of the printing head 34 and a region on the upstream of the printing position 402 in the medium 40.

Figure 5:
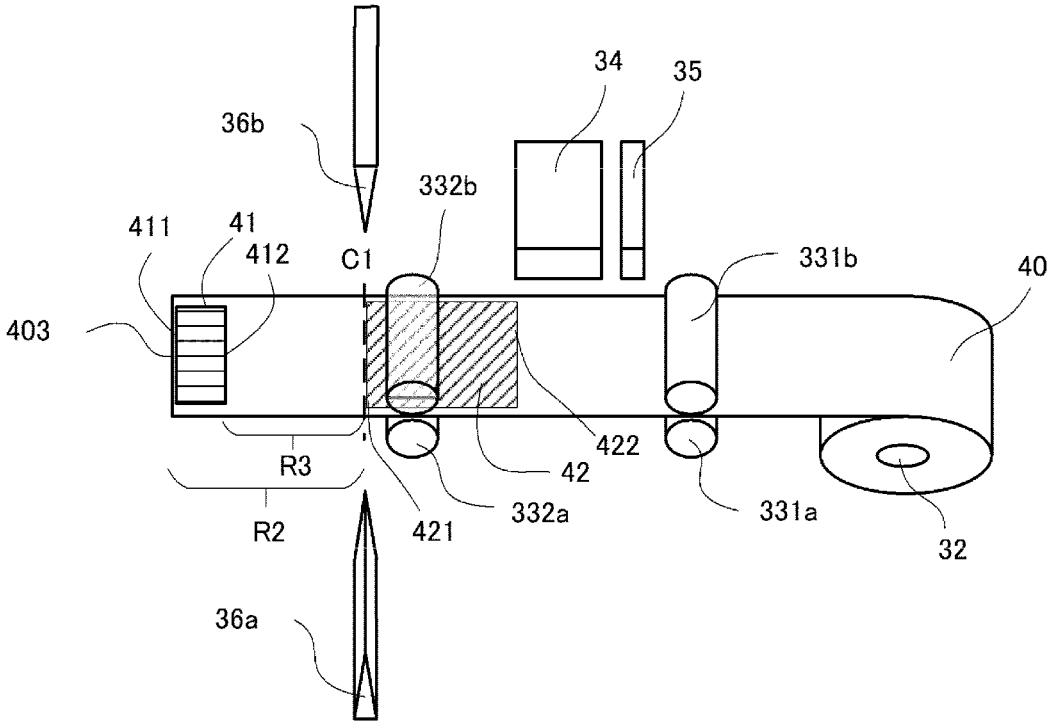
FIG. 5 is a diagram for explaining the overview of the medium cut of the related art.

After completing the printing, the printing apparatus of the related art conveys the medium 40 such that a downstream end 421 of a printing region 42 in the medium 40 reaches the vicinity of the cut position C1 of the cutter 36. In FIG. 5, a state in which the medium 40 is conveyed until the downstream end 421 of the printing region 42 reaches the vicinity on the upstream of the cut position C1 of the cutter 36 is shown. The printing apparatus of the related art cuts the medium 40 using the cutter 36. When the downstream end 421 of the printing region 42 in the medium 40 reaches the vicinity of the cut position C1 of the cutter 36 halfway in the printing, the printing apparatus of the related art cuts the medium 40 using the cutter 36 in the position. In this way, in the printing apparatus of the related art, when the medium 40 is attached, a region R2 from the downstream end 403 of the medium 40 to the vicinity of the downstream end 421 of the printing region 42 is cut.

Thereafter, the printing apparatus of the related art conveys the medium 40 such that an upstream end 422 of the printing region 42 reaches the vicinity of the downstream end of the cut position C1 of the cutter 36, cuts the medium 40 using the cutter 36, and outputs the cut medium 40 as a printing result to complete the printing. Thereafter, the printing apparatus of the related art performs printing every time the printing is instructed.

As explained above, in the printing apparatus of the related art, the region R1 and the region R2 are cut when the medium 40 is detached and attached. In this way, in the printing apparatus of the related art, a region R3 that is cut without being used for printing and the like and wasted is present between an upstream end 412 of the medium information 41 and the downstream end 421 of the printing region 42 in printing performed new.

Figure 6:
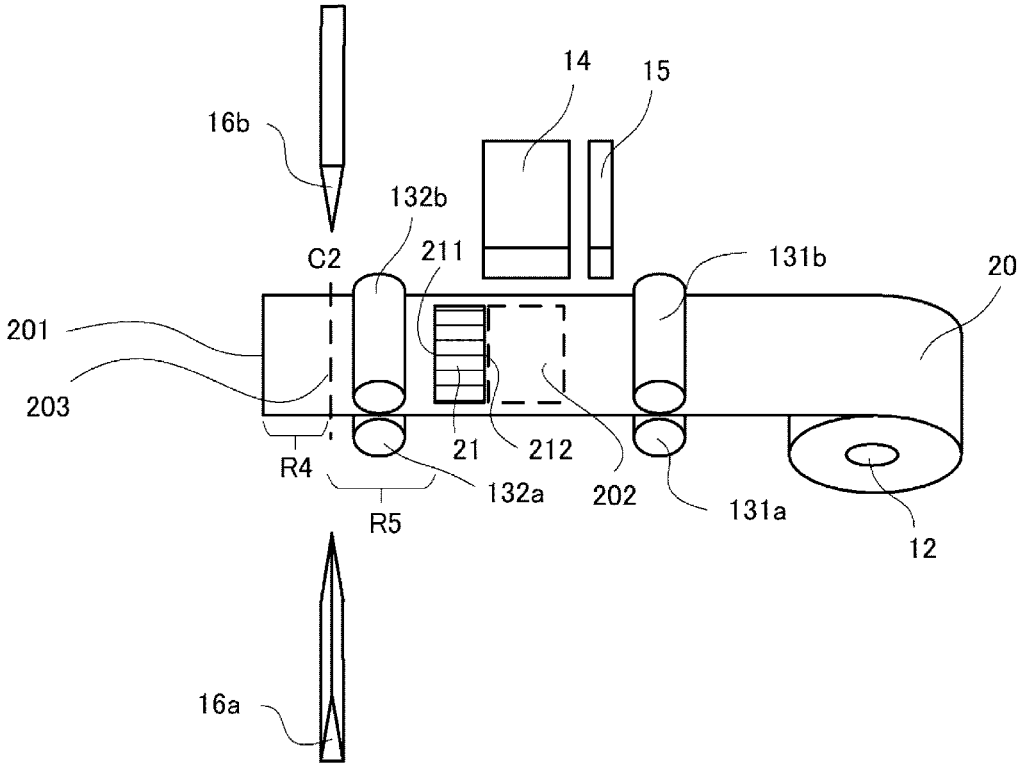
FIG. 6 is a diagram for explaining the overview of the medium cut of the related art.
Figure 7:
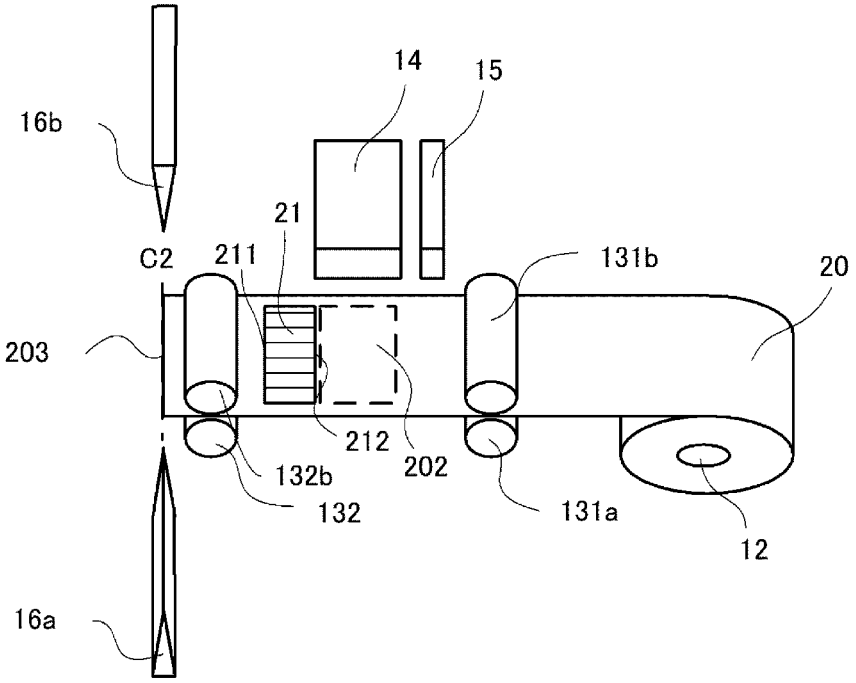
FIG. 7 is a diagram for explaining the overview of the medium cut of the related art.
Figure 8:
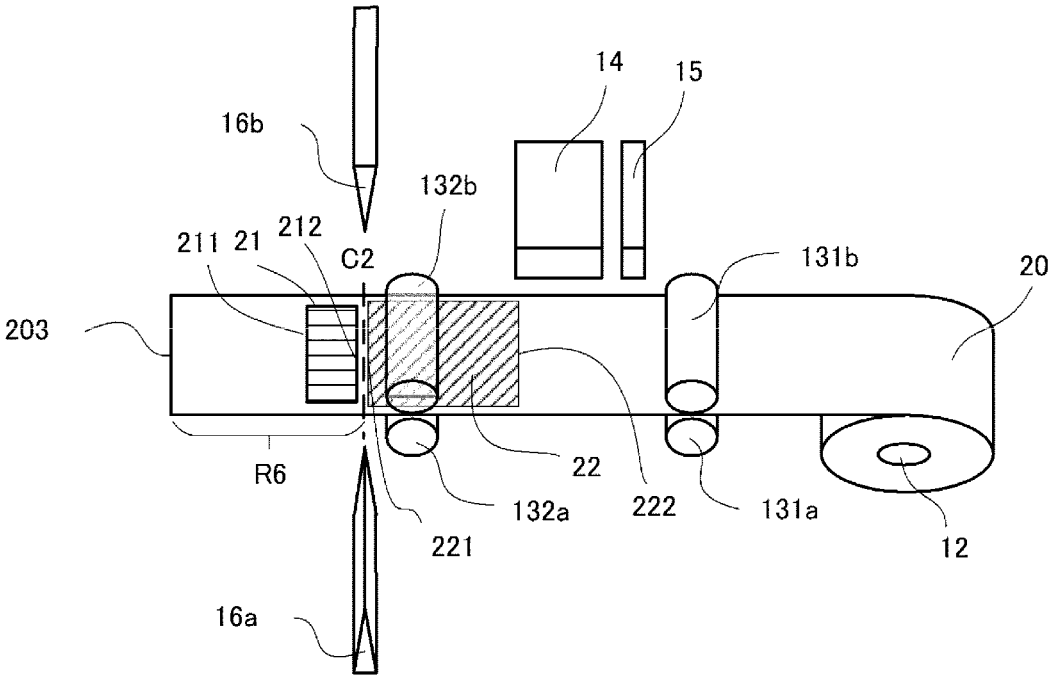
FIG. 8 is a diagram for explaining the overview of the medium cut of the related art.

Subsequently, an overview of processing in the case of detachment and attachment of the medium 20 in the printing apparatus 10 in this embodiment is explained with reference to FIGS. 6 to 8.

In a state in which printing is completed (a state in which an instruction for printing is not received), the printing apparatus 10 receives a replacement instruction for the medium 20 through operation of an input section of the printing apparatus 10 by a user. When receiving the replacement instruction for the medium 20, the printing apparatus 10 conveys the medium 20 such that a downstream end 201 of the medium 20 reaches a cut position C2 of the cutter 16 in the same manner as shown in FIG. 2 and prints, on the medium 20, medium information 21 indicating information concerning the medium 20.

Thereafter, the printing apparatus 10 conveys the medium 20 such that a downstream end 211 of the medium information 21 is located further on the upstream than the downstream roller 132. In this embodiment, after the printing of the medium information 21 responding to the reception of the replacement instruction for the medium 20 ends, the printing apparatus 10 conveys the medium 20 until the medium information 21 passes a printing position 202 of the printing head 14. A state in which the medium 20 is conveyed until the medium information 21 passes the printing position 202 is shown in FIG. 6. In this state, a total of the distance between the downstream end 201 of the medium 20 and the downstream end 211 of the medium information 21 and the width in the conveying direction of the medium information 21 is (the distance between the downstream end 201 of the medium 20 and an upstream end 212 of the medium information 21 is) equal to the distance on the conveyance path between the cutter 16 and the downstream end of the printing position 202. Further the printing apparatus 10 cuts the medium 20 using the cutter 16 without conveying the medium 20. That is, a region R4 shown in FIG. 6 is cut.

In this way, unlike the printing apparatus of the related art, the printing apparatus 10 cuts the medium 20 in a state in which the downstream end 211 of the medium information 21 is located further on the upstream than the downstream roller 132. That is, the medium 20 is cut such that a blank region R5 is formed between the cut position C2 and the downstream end 211.

After cutting the medium 20, the printing apparatus 10 rewinds the medium 20 into a roll shape to enable the medium 20 to be detached. Thereafter, the medium 20 is detached by the user. In this way, in the printing apparatus 10, the region R4 is cut. A downstream end 203 of the medium 20 after the cut of the region R4 is the upstream end of the region R4 before the cut of the region R4.

When the medium 20 is attached again, the printing apparatus 10 conveys the medium 20 until the medium information 21 of the medium 20 enters a reading range of the sensor 15. The printing apparatus 10 reads the medium information 21 using the sensor 15 and grasps information concerning the attached medium 20. Thereafter, when printing is instructed, the printing apparatus 10 conveys the medium 20 until the downstream end 203 of the medium 20 reaches the cut position C2 of the cutter 16. In FIG. 7, a state in which the medium 20 is conveyed until the downstream end 203 reaches the cut position C2 is shown.

In this state, the printing apparatus 10 performs, using the printing head 14, printing in the printing position 202 and a region on the upstream of the printing position 202 in the medium 20. The distance from the downstream end 203 of the medium 20 to the upstream end 212 of the medium information 21 is substantially equal to the distance between the cutter 16 and the printing position 202 on the conveyance path. Accordingly, the printing apparatus 10 can use, for the printing, the upstream end 212 of the medium information 21 and a region on the upstream of the upstream end 212 and can minimize a useless region formed between the medium information 21 and a printing region 22.

After completing the printing, the printing apparatus 10 conveys the medium 20 such that a downstream end 221 of the printing region 22 reaches the vicinity on the upstream of the cut position C2. In FIG. 8, a state in which the medium 20 is conveyed such that the downstream end 221 reaches the vicinity on the upstream of the cut position C2 is shown. The printing apparatus 10 cuts the medium 20 using the cutter 16. Alternatively, when the downstream end 221 of the printing region 22 in the medium 20 reaches the vicinity of the cut position C2 of the cutter 16 halfway in the printing, the printing apparatus 10 cuts the medium 20 using the cutter 16 in the position. In this way, in the printing apparatus 10, when the medium 20 is attached, a region R6 from the downstream end 203 to the vicinity of the downstream end 221 is cut.

Thereafter, the printing apparatus 10 conveys the medium 20 such that an upstream end 222 of the printing region 22 reaches the vicinity on the downstream of the cut position C2 of the cutter 16, cuts the medium 20 using the cutter 16, and outputs the cut medium 20 as a printing result to complete the printing. Thereafter, the printing apparatus 10 performs printing every time the printing is instructed.

As explained above, unlike the printing apparatus of the related art, in the detachment of the medium 20, the printing apparatus 10 does not cut the medium 20 in the vicinity of the downstream end 211 of the medium information 21 and cuts the medium 20 in a state in which the downstream end 211 of the medium information 21 is located upstream of the downstream roller 132. That is, the medium 20 is cut such that the blank region R5 remains between the medium 20 and the medium information 21.

Consequently, in the attachment of the medium 20, the printing apparatus 10 can perform printing in a state in which the medium information 21 is located further upstream compared with when such a blank region is absent. As a result, the printing apparatus 10 can reduce a region between the printing region 22 and the medium information 21 compared with the printing apparatus of the related art. That is, the printing apparatus 10 can further reduce a portion corresponding to the region R3 cut in the printing apparatus of the related art. As a result, the printing apparatus 10 can reduce a portion cut in detachment and attachment of the medium 20 and can further save the medium 20 compared with the printing apparatus of the related art.

(2-2) Processing in Medium Detachment

Subsequently, details of processing of the printing apparatus 10 in detachment of the medium 20 are explained with reference to a flowchart of FIG. 9.

Figure 9:
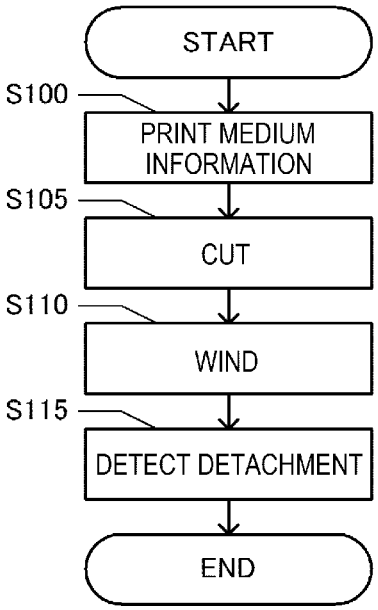
FIG. 9 is a flowchart showing an example of processing for detaching a medium.

In a state in which printing is completed (a state in which printing is not performed), when receiving a replacement instruction for the medium 20 through operation of the user on an input device of the printing apparatus 10, the processor 11 starts the processing shown in FIG. 9. In this embodiment, at a start point in time of the processing shown in FIG. 9, a portion of the medium 20 used for printing performed immediately before the processing is cut.

In this embodiment, when printing is not performed in the printing apparatus 10, the medium 20 is in a state in which the preceding printing is completed (a state in which the downstream end is conveyed to the cut position C2 of the cutter 16). However, in order to prevent a situation in which the medium 20 is kept nipped by the upstream roller 131 and the downstream roller 132 to be damaged, every time printing is completed, the processor 11 may wind the medium 20 to a position upstream of the upstream roller 131. In that case, before processing in S100, the processor 11 conveys the medium 20 using the medium rotating shaft 12 and the conveying roller 13 until the downstream end of the medium 20 reaches the cut position C2 of the cutter 16.

In this embodiment, when the printing apparatus 10 performs printing, the position of the downstream end 201 of the medium 20 reaches the cut position C2 of the cutter 16 at a start point in time of the printing.

In S100, the processor 11 prints, using the printing head 14, the medium information 21 indicating the information concerning the medium 20 in the printing position 202 and a region on the upstream of the printing position 202 in the medium 20.

In this embodiment, the processor 11 performs printing while conveying the medium 20. Consequently, in printing performed using the printing head 14, the medium 20 is conveyed by the width of a printed printing region. More specifically, the processor 11 once prints a range printable by the printing head 14, thereafter, conveys the medium 20 by the width in the conveying direction of the printing position 202, and prints the range printable by the printing head 14 again. When completing the printing, the processor 11 conveys the medium 20 by the width in the conveying direction of the printing position 202. Accordingly, when printing of the medium information 21 is completed, the medium information 21 is in a state in which the medium information 21 has passed the printing position 202 (a state in which the upstream end 212 of the medium information 21 and the downstream end of the printing position 202 are the same position).

In this embodiment, information concerning the medium 20 is stored in the storage of the printing apparatus 10 in advance. Accordingly, the processor 11 acquires the information concerning the medium 20 from the storage of the printing apparatus 10 and prints medium information indicating the acquired information.

In S105, the processor 11 does not further convey the medium 20 after the conveyance of the medium 20 in S100 and cuts the region R4 at the downstream end of the medium 20 using the cutter 16. The downstream end 201 is located in the cut position C2 before the start of the processing shown in FIG. 9. Since the medium 20 is conveyed by the width in the conveying direction of the medium information 21 in the processing in S100, at an end point in time of the processing in S100, the downstream end 201 is located downstream from the cut position C2 by the width in the conveying direction of the medium information 21. Accordingly, the width in the conveying direction of the region R4 is equal to the width in the conveying direction of the medium information 21. That is, at a completion point in time of the processing in S105, the distance between the downstream end 203 of the medium 20 after the cut and the upstream end 212 of the medium information 21 is equal to the distance between the cut position C2 of the cutter 16 and the downstream end of the printing position 202 on the conveyance path.

In S110, the processor 11 winds the medium 20 into a roll shape using the medium rotating shaft 12 and the conveying roller 13 to enable the medium 20 to be detached. In this embodiment, the processor 11 notifies the user that the medium 20 is in a detachable state. For example, the processor 11 may output, using a speaker of the printing apparatus 10, sound (for example, buzzer sound or text voice) indicating that the medium 20 is in the detachable state to notify the user that the medium 20 is in the detachable state. For example, the processor 11 may display, on a display section of the printing apparatus 10, information (for example, a text) indicating that the medium 20 is in the detachable state to notify the user that the medium 20 is in the detachable state. For example, the processor 11 may light a lighting section of the printing apparatus 10 to notify the user that the medium 20 is in the detachable state. Consequently, the processor 11 can notify the user that the medium 20 is in the detachable state and can further improve convenience for the user. Thereafter, the medium 20 is detached by the user.

In S115, the processor 11 detects detachment of the medium 20 and ends the processing shown in FIG. 9.

(2-3) Processing in Medium Attachment

Details of processing of the printing apparatus 10 in attachment of the medium 20 are explained with reference to a flowchart of FIG. 10.

Figure 10:
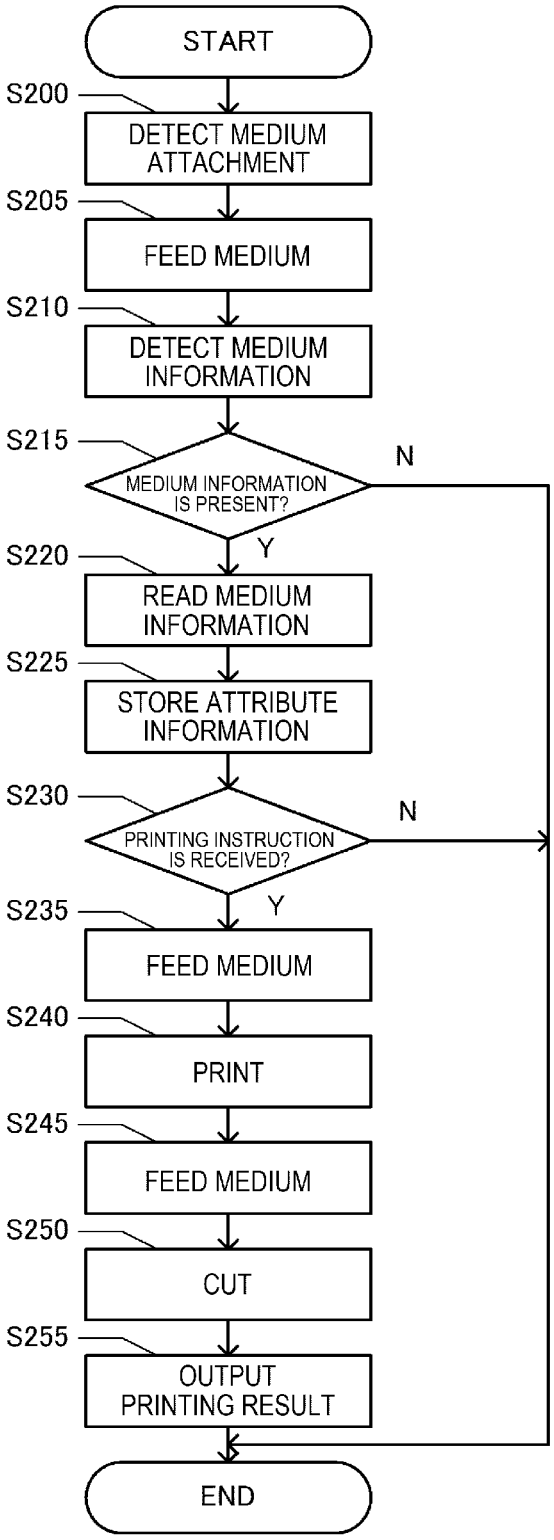
FIG. 10 is a flowchart showing an example of processing for attaching a medium.

The processor 11 starts the processing shown in FIG. 10 when the medium 20 printed with the medium information and cut in the processing shown in FIG. 9 is attached to the printing apparatus 10 again by the user.

In S200, the processor 11 detects attachment of the medium 20. In this embodiment, the processor 11 detects closing of a cover of the printing apparatus 10 after the attachment of the medium 20 to detect the attachment of the medium 20. However, the processor 11 may detect the attachment of the medium 20 by another method. For example, the processor 11 may detect pressing of a set button of the printing apparatus 10 after the attachment of the medium 20 to detect the attachment of the medium 20.

In S205, the processor 11 conveys the medium 20 by a predetermined distance using the medium rotating shaft 12 and the conveying roller 13 such that the medium information 21 on the medium 20 enters a readable region of the sensor 15.

In S210, the processor 11 detects the medium information 21 using the sensor 15.

In this way, in this embodiment, the processor 11 performs the processing in S205 to S210 to detect the medium information 21. However, the processor 11 may detect the medium information 21 with another method. For example, while conveying the medium 20 using the medium rotating shaft 12 and the conveying roller 13, the processor 11 may detect the medium information 21 using the sensor 15 during the conveyance.

In S215, the processor 11 determines whether the medium information 21 is successfully detected from the medium 20. When determining that the medium information 21 is successfully detected, the processor 11 advances the processing to S220. When determining that the medium information 21 is not successfully detected, the processor 11 ends the processing shown in FIG. 10.

In S220, the processor 11 reads the medium information 21 detected in S210 to acquire information concerning the medium 20.

In S225, the processor 11 stores the information acquired in S220 in the storage of the printing apparatus 10. Thereafter, the processor 11 controls the medium 20 based on the stored information. For example, when information concerning a residual amount of the medium 20 is included in the information acquired in S220, the processor 11 can convey the medium 20 at constant conveying speed irrespective of the residual amount of the medium 20 by performing control of conveying speed of the medium 20 based on the diameter of a roll corresponding to the residual amount of the medium 20. For example, when receiving a printing instruction for an image having a size that cannot be printed with the residual amount of the medium 20, the processor 11 performs processing for notifying the user that printing cannot be performed.

In S230, the processor 11 determines whether a printing instruction is received. When determining that the printing instruction is received, the processor 11 advances the processing to S235. When determining that the printing instruction is not received, the processor 11 advances the processing to S260.

In S235, the processor 11 conveys the medium 20 using the medium rotating shaft 12 and the conveying roller 13 such that the downstream end 203 of the medium 20 reaches the cut position C2 of the cutter 16. In the medium 20 cut in S115 in FIG. 9, the distance from the downstream end of the medium 20 to the upstream end of the medium information 21 is the same as the distance from the cutter 16 to the printing position of the printing head 14 on the conveyance path. Accordingly, at a completion point in time of the processing in S235, the medium information 21 of the medium 20 is adjacent to the printing position 202 of the printing head 14 on the upstream.

In S240, the processor 11 controls the printing head 14, the medium rotating shaft 12, and the conveying roller 13 and prints an image corresponding to the printing instruction on the medium 20.

In S245, the processor 11 conveys the medium 20 using the medium rotating shaft 12 and the conveying roller 13 such that the position of the upstream end 212 of the medium information 21 reaches the cut position C2.

In S250, the processor 11 cuts the medium 20 using the cutter 16.

In S255, the processor 11 conveys the medium 20 using the medium rotating shaft 12 and the conveying roller 13 such that the upstream end of the image printed in S240 reaches the vicinity on the downstream of the cut position C2 of the cutter 16. The processor 11 cuts the medium 20 using the cutter 16 and outputs the cut medium 20 as a printing result.

With the configuration explained above, in the detachment of the medium 20, the printing apparatus 10 can leave a blank on the downstream of the medium information 21 by cutting the medium 20 in a state in which the medium information 21 is located further on the upstream than the downstream roller 132. Consequently, in the attachment of the medium 20, the printing apparatus 10 can further reduce a region between the medium information 21 and a new printing region 22 than when such a blank is not left. That is, the printing apparatus 10 can further reduce a portion cut in the case of the detachment and the attachment of the medium 20 and further save the medium 20.

In this embodiment, after the printing of the medium information responding to the reception of the replacement instruction for the medium 20 ends, the printing apparatus 10 conveys the medium 20 until the medium information passes the printing position of the printing head 14 and cuts the medium 20 without further conveying the medium 20. Consequently, a blank is formed between the downstream end of the medium information and the medium 20 such that the distance from the upstream end of the medium information to the downstream end of the medium 20 is equal to the distance between the cutter 16 and the printing position of the printing head 14 on the conveyance path. Consequently, the printing apparatus 10 can align the upstream end of the medium information with the position of the downstream end of the printing head 14 by simply conveying the medium 20 until the downstream end of the medium 20 reaches the cut position C2 of the cutter 16. The printing apparatus 10 can use the medium information and a region on the upstream of the medium information for printing. That is, the printing apparatus 10 can minimize a region between the upstream end of the medium information and the downstream end of a printing region of printing to be performed anew and can further save the medium 20. If a blank having larger length in the conveying direction is formed, the printing apparatus 10 specifies the position of the medium information in the medium 20 and adjusts a conveying distance of the medium 20 to align the upstream end of the specified position of the medium information with the position of the downstream end of the printing position of the printing head 14. That is, such adjustment is unnecessary in the printing apparatus 10. That is, the printing apparatus 10 can reduce a processing load.

The printing apparatus 10 includes the cutter 16 that cuts the medium 20 according to an instruction of the processor 11. The printing apparatus 10 cuts the medium 20 using the cutter 16. Consequently, the printing apparatus 10 can cut the medium 20 without requiring labor and time of the user and can reduce the labor and time of the user.

(3) Other Embodiments

The embodiment explained above is an example for carrying out the present disclosure. Other various embodiments can be adopted. For example, the printing apparatus may be a multifunction peripheral including a scanner function and a FAX function. Further, the method of adjusting the cut position and cutting the medium as in the embodiment explained above can also be realized as an invention of a program, an invention of a method, and the like.

The embodiment explained above is an example. Embodiments in which a part of the components is omitted and other components are added or substituted can be adopted.

In the embodiment, the printing apparatus 10 receives the replacement instruction for the medium for printing through the operation of the input section of the printing apparatus 10 by the user. However, the printing apparatus 10 may receive the replacement instruction for the medium with another method. For example, the printing apparatus 10 may receive the replacement instruction for the medium from a client computer connected by wire or radio.

In the embodiment, the barcode is used as the medium information. However, another kind of information may be used as the medium information if the information can indicate the information concerning the medium 20. The printing apparatus 10 may use, for example, a two-dimensional code or a text as the medium information. The printing apparatus 10 may use a plurality of kinds of information (for example, a barcode and a text) as the medium information.

In the embodiment, when starting the printing, the printing apparatus 10 sets the position of the downstream end of the medium 20 as the position of the cutter 16. However, when staring the printing, the printing apparatus 10 only has to nip the medium 20 with at least the downstream roller 132. Accordingly, the printing apparatus 10 may set the position of the downstream end of the medium 20 at the start of the printing to another position such as the position of the downstream roller 132.

In the embodiment, the printing apparatus 10 includes the cutter 16 that cuts the medium 20 according to an instruction of the processor 11. However, the printing apparatus 10 may not include the cutter 16 that cuts the medium 20 according to an instruction of the processor 11.

In that case, for example, the printing apparatus 10 may include, in the position of the cutter 16, instead of the cutter 16, a cutter that does not operate. The medium 20 may be cut by the cutter when a cutting target portion of the medium 20 is pulled to the cutter side by the user. For example, the printing apparatus 10 may not include a cutter itself and may print, on the medium 20, information (for example, a line) indicating a cut position, convey the medium 20 until the user can visually recognize the information, and wait for the medium 20 to be cut by the user.

In such a case, the processor 11 does not perform the processing for controlling the cutter 16 in S115, S250, and S255. However, the processor 11 may perform output (for example, sound output performed using the speaker or the like of the printing apparatus 10 or display output to the display section or the like of the printing apparatus 10) of information for instructing a cut of the medium 20 to instruct the user to cut the medium 20.

In the embodiment, in the detachment of the medium 20, the printing apparatus 10 conveys the medium 20 to the position where the medium information 21 passes the printing position 202. The printing apparatus 10 cuts the medium 20 without further conveying the medium 20. However, in the detachment of the medium 20, if the downstream end 211 of the medium information 21 is set as the upstream of the downstream roller 132, the printing apparatus 10 may convey the medium 20 such that the medium information 21 reaches any position and cut the medium 20.

Figure 12:
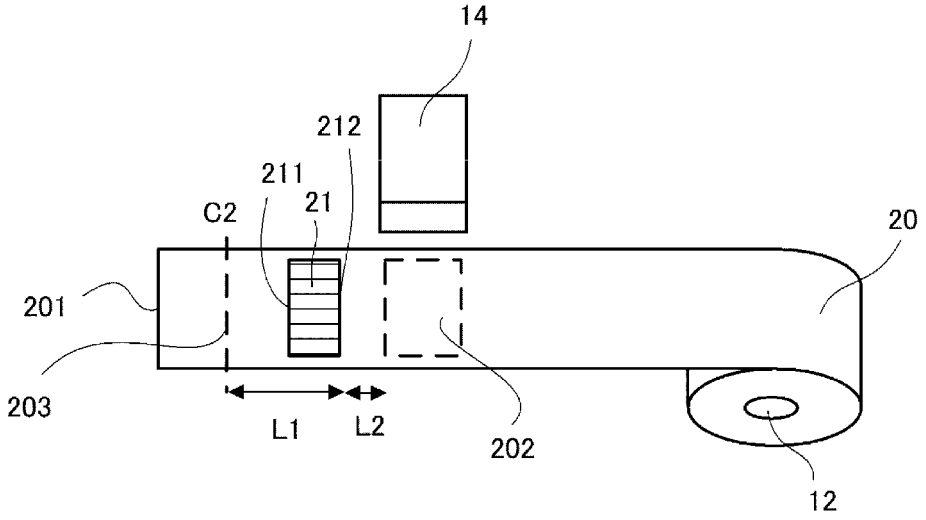
FIG. 12 is a diagram showing an example of a state of a medium when being cut.

For example, when the medium 20 is replaced, that is, when the medium 20 is detached in response to the replacement instruction for the medium 20, the processor 11 only has to cut the medium 20 as explained below. That is, the processor 11 only has to cut the medium 20 such that the distance between the downstream end 203 of the medium 20 after the cut and the upstream end 212 of the medium information 21 is longer than the distance between the upstream end 212 and the downstream end 221 of the printing region 22 of printing performed anew on the medium 20. This is explained with reference to FIG. 12. The processor 11 may be configured to convey the medium 20 such that a distance L1 in the conveying direction between the cut position C2 (the downstream end 203 after the cut) and the upstream end 212 is longer than a distance L2 in the conveying direction between the upstream end 212 and the downstream end of the printing position 202 (the downstream end of the printing region 22) and cut the medium 20. That is, the processor 11 may be configured to cut the medium 20 in a state in which the upstream end 212 of the medium information 21 is located further on the upstream than the center between the downstream roller 132 and the printing position 202 in the conveyance path.

Consequently, the processor 11 can further reduce a uselessly cut region (a region between the upstream end 212 and the downstream end of the printing position 202) and further save the medium 20 compared with when the medium is conveyed such that the distance L1 is equal to or smaller than the distance L2 and cut. However, the processor 11 may convey the medium 20 such that the distance L1 is equal to or smaller than the distance L2 and cut the medium 20. In that case as well, the printing apparatus 10 can reduce a region between the upstream end 212 and the downstream end of the printing region 22 of printing performed anew compared with the printing apparatus of the related art.

For example, in the cut of the medium 20 responding to the reception of the replacement instruction for the medium 20, the processor 11 only has to set, as a cut position, a position at a distance equal to or smaller than the width in the conveying direction of the medium information 21 in the conveying direction from the downstream end 201 of the medium 20 before the cut and cut the medium 20. That is, the processor 11 only has to cut, as the region R4, a region where the width in the conveying direction is equal to or smaller than the width in the conveying direction of the medium information 21. In such a case, for example, when the medium 20 is attached again, the processor 11 only has to perform printing after conveying the medium 20 to align the positions of the upstream end 212 of the medium information 21 and the downstream end of the printing position 202.

In this way, the printing apparatus 10 can further save the medium 20 by minimizing the region between the upstream end 212 and the downstream end of the printing region 22 of the printing performed new. However, the processor 11 may set, as a cut position, a position downstream of the width in the conveying direction of the medium information 21 in the conveying direction from the downstream end 201 of the medium 20 before the cut and cut the medium 20. In the case as well, the printing apparatus 10 can reduce the region between the upstream end 212 and the downstream end of the printing region 22 of the printing performed anew compared with the printing apparatus of the related art.

In the embodiment, when the detachment of the medium 20, the outer surface of which is the printing surface, the printing apparatus 10 prints the medium information on the medium 20 and cuts the medium 20. However, the printing apparatus 10 may perform operation as in the embodiment for a medium, the inner surface of which is the printing surface, but may not cut the medium 20, the outer surface of which is the printing surface, unlike the embodiment.

When the outer surface of the medium 20 is the printing surface, even if the medium 20 is not cut when being detached, the medium information of the detached medium 20 can be visually recognized. For example, when the medium information includes a text visually recognizable by the user, the user can easily grasp the medium information by visually recognizing the medium 20.

In contrast, when the inner surface of the medium 20 is the printing surface, the medium information printed on the medium 20 cannot be visually recognized in a state in which the medium 20 is wound in a roll shape. For example, when medium information includes a text recognizable by the user, the user cannot visually recognize the medium information unless the user turns over the medium 20. Therefore, it takes time to grasp the medium information. Accordingly, when the medium 20 is not cut when being detached, an amount of the medium 20 that the user has to turn over in order to grasp the medium information increases and labor and time of the user increases. However, by cutting the medium 20 when detaching the medium 20, the user can confirm the printed medium information only by slightly turning over the medium 20.

Therefore, in the detachment of the medium 20, the printing apparatus 10 may cut the medium 20 when the printing surface of the medium 20 is the inner surface and may not cut the medium 20 when the printing surface of the medium 20 is the outer surface. Details of processing in that case is explained with reference to FIG. 11.

Figure 11:
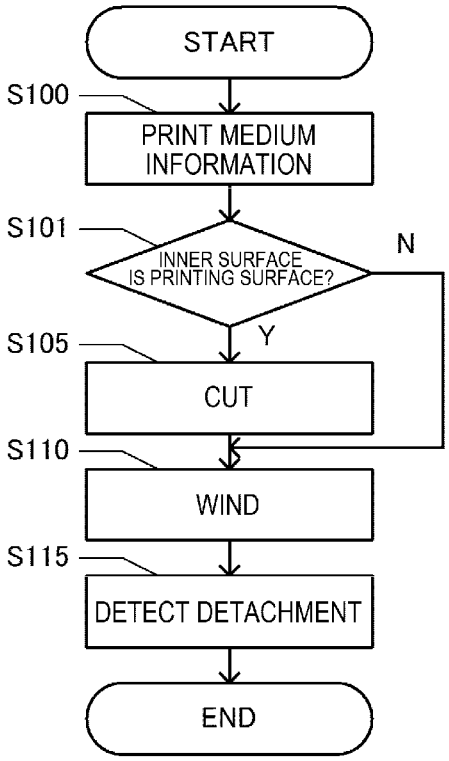
FIG. 11 is a flowchart showing an example of processing for detaching a medium.

The processing shown in FIG. 11 is different from the processing shown in FIG. 9 in that the processing includes the processing in S101 between S100 and S105. In the processing shown in FIG. 11, differences from the processing shown in FIG. 9 are explained.

In S101, the processor 11 acquires, from the storage of the printing apparatus 10, information indicating whether a printing surface of the medium 20 designated from the user in advance is the inner surface or the outer surface. The processor 11 determines, based on the acquired information, whether the printing surface of the medium 20 is the inner surface. 'However, for example, when the medium 20 is conveyed using a conveyance path for a medium, the outer surface of which is the printing surface, the processor 11 may determine that the printing surface of the medium 20 is the outer surface. When the medium 20 is conveyed using a conveyance path for a medium, the inner surface of which is the printing surface, the processor 11 may determine that the printing surface of the medium 20 is the inner surface. When determining that the printing surface of the medium 20 is the inner surface, the processor 11 advances the processing to S105. When determining that the printing surface of the medium 20 is the outer surface, the processor 11 advances the processing to S110 without performing the processing in S105.

In this way, the printing apparatus 10 performs control not to cut the medium 20 when the printing surface of the medium 20 is the outer surface. Consequently, it is possible to reduce the number of times of operation of the cutter 16 and prolong the life of the cutter 16 without degrading convenience for the user. This holds true irrespective of where the medium 20 is cut if the medium 20 is cut when the printing surface is simply the inner surface.

Each of the upstream roller and the downstream roller only has to be able to convey the medium while nipping the medium.

The sensor only has to be able to be used for reading of medium information. The sensor may be, for example, a camera capable of photographing an image. In this case, the processor reads medium information from an acquired image. When the medium information is a barcode, the sensor may be a barcode scanner.

The cutter only has to be able to cut the medium. The cutter may be configured by two edged tools that vertically nip the medium as in the embodiment explained above or may be configured by a base that receives the medium and an edged tool movable in a conveying direction of the medium and the vertical direction on the base.

As a printing method for the printing apparatus 10, any method such as a serial scheme or a line scheme may be adopted.

Further, the present disclosure is also applicable as a program and a method executed by a computer. The program and the method explained above are realized as an independent apparatus in some cases and are realized using components included in a plurality of apparatuses in other cases. The program and the method include various forms. The program and the method can be changed as appropriate, for example, a part of the program and the method is software and a part of the program and the method is hardware. Further, an invention is established as a recording medium for a program. Naturally, the recording medium for the program may be a magnetic recording medium or may be a semiconductor memory. All recording media to be developed in future can be considered completely the same.

What is claimed is:

1. A printing apparatus comprising:

an upstream roller configured to convey a medium;

a downstream roller configured to convey the medium;

a sensor;

a printing head configured to perform, in a printing position, printing on the medium conveyed by the upstream roller on the upstream and by the downstream roller on the downstream; and a processor configured to perform control on a new medium based on medium information read from the new medium using the sensor, wherein the processor prints the medium information on the medium using the printing head in response to reception of a replacement instruction for the medium, causes the printing apparatus to cut the medium in a state in which a downstream end of the medium information is located further on the upstream than the downstream roller, and, thereafter, causes the printing apparatus to detach the medium.

2. The printing apparatus according to claim 1, wherein, after the printing of the medium information responding to the reception of the replacement instruction for the medium ends and the medium information passes the printing position according to the conveyance of the medium, the processor causes the printing apparatus to cut the medium and rewind the medium and, thereafter, causes the printing apparatus to detach the medium without causing the printing apparatus to further convey the medium.

3. The printing apparatus according to claim 1, wherein a distance between a downstream end of the medium and an upstream end of the medium information at a replacement time of the medium is longer than a distance between the upstream end of the medium information and a downstream end of a printing region in printing performed on the medium anew.

4. The printing apparatus according to claim 1, further comprising a cutter configured to cut the medium according to an instruction of the processor.

5. The printing apparatus according to claim 1, wherein, in the cut of the medium responding to the reception of the replacement instruction for the medium, the processor sets, as a cut position, a position at a distance equal to or smaller than width in a conveying direction of the medium information from a downstream end of the medium before the cut.

6. The printing apparatus according to claim 1, wherein, when an outer surface of the medium is a printing surface, the processor causes, in response to the reception of the replacement instruction for the medium, the printing apparatus to print the medium information on the medium using the printing head and, thereafter, causes the printing apparatus to rewind the medium to enable the medium to be detached without causing the printing apparatus to cut the medium and, when an inner surface of the medium is the printing surface, causes the printing apparatus to print the medium information on the medium using the printing head and, thereafter, causes the printing apparatus to cut the medium and rewind the medium, and causes the printing apparatus to detach the medium.

* * * * *